US006478375B2

(12) United States Patent
Richardson

(10) Patent No.: US 6,478,375 B2
(45) Date of Patent: Nov. 12, 2002

(54) METAL FOLDING CHAIR HAVING GANGING DEVICE

(75) Inventor: James M. Richardson, West Springfield, MA (US)

(73) Assignee: Columbia Manufacturing, Inc., Westfield, MA (US)

( * ) Notice: Subject to any disclaimer, the term of this patent is extended or adjusted under 35 U.S.C. 154(b) by 23 days.

(21) Appl. No.: 09/775,995

(22) Filed: Feb. 2, 2001

(65) Prior Publication Data

US 2002/0105214 A1 Aug. 8, 2002

(51) Int. Cl.[7] ..... A47C 15/00
(52) U.S. Cl. ..... 297/248; 297/56; 297/16.1
(58) Field of Search ..... 297/248, 249, 297/440.1, 56, 16.1; 248/222.41, 225.11; 411/330, 546

(56) References Cited

U.S. PATENT DOCUMENTS 2,548,098 A 4/1951 Clarin
3,009,738 A * 11/1961 Piker ..... 297/248
3,099,479 A 7/1963 Banke
3,127,218 A * 3/1964 Banke ..... 297/248
3,227,487 A 1/1966 Blanchard
3,281,184 A 10/1966 Axtell
3,614,157 A * 10/1971 Hendrickson et al. ..... 297/248
3,827,749 A 8/1974 Johnson et al.
5,490,365 A * 2/1996 Roth ..... 52/704
5,863,096 A 1/1999 Bartlmae
5,954,396 A * 9/1999 Kemnitzer ..... 297/248

* cited by examiner

*Primary Examiner*—Anthony D. Barfield
*Assistant Examiner*—Stephanie Harris
(74) *Attorney, Agent, or Firm*—McCormick, Paulding & Huber LLP

(57) ABSTRACT

A metal folding chair having a tubular frame and a ganging device including female keyslots formed in internally reinforced portions of one side of the frame and male connecting elements including studs mounted in cantilever positions on an opposite side of the frame by tee nuts threadably engaged with the studs within the frame.

22 Claims, 2 Drawing Sheets

METAL FOLDING CHAIR HAVING GANGING DEVICE

FIELD OF INVENTION

This invention relates in general to chairs and seats and deals more particularly with a metal folding chair of a type having a ganging feature.

BACKGROUND OF THE INVENTION

A typical metal folding chair of the type with which the present invention is concerned includes a ganging device for releasably connecting the chair in side-by-side relation to other chairs of like kind to form a uniform row or ganged arrangement of connected chairs. Such chairs are usually found in auditoriums, gymnasiums, meeting halls and other places of assembly where temporary seating in orderly fashion may be required. A metal folding chair having a ganging feature usually includes male and female connecting elements attached to and projecting outwardly from opposite sides of the chair. Examples of such chairs are found in U.S. Patents to Banke, U.S. Pat. No. 3,127,218, and Blanchard, Jr., et al., U.S. Pat. No. 3,227,487.

Separable folding chairs of the aforedescribed general type are usually subjected to considerable handling and may be frequently set up to provide temporary seating and, thereafter, knocked down for storage in folded condition. Consequently, such chairs are often subjected to rough handling. Any protruding parts, such as the attachments employed to make ganging connections, are frequently subjected to the risk of damage from rough handling. Further, where such chairs may be used in unconnected relation to other chairs for random seating the projecting parts which comprise the ganging devices present a hazard to clothing which may catch on a projecting part of a chair and be torn.

Accordingly, it is the general aim of the present invention to provide an improved metal folding chair having an unobtrusive ganging device with minimal projecting parts. It is further aim of the invention to provide an improved chair having durable coupling parts for ganging connection and which are highly resistant to damage caused by rough chair handling.

SUMMARY OF THE INVENTION

In accordance with the present invention a metal folding chair has a tubular frame including a unitary tubular main frame member of generally rectangular cross-section. The main frame member defines a pair of elongated parallel side portions and an integral backrest support which extends transversely between the side portions and carries a backrest. The chair also has a seat pivotally connected to the frame. A coupling means or ganging device is provided for releasably securing the folding chair in adjacent side-by-side relation to one or more other chairs of like kind and includes at least one female connecting element or keyslot defined by an internally reinforced outer sidewall of an associated one of the side portions. The keyslot opens outwardly through the outer sidewall of one of the main frame side portions and communicates with the interior of the tubular main frame member. The reinforced portion includes a reinforcing plate disposed within the tubular main frame member and mounting means for securing the reinforcing plate in fixed position on and within the tubular main frame member in the engagement with an inner surface of the outer sidewall of the associated one of the side portions.

DETAILED DESCRIPTION OF PREFERRED EMBODIMENT

Figure 1:
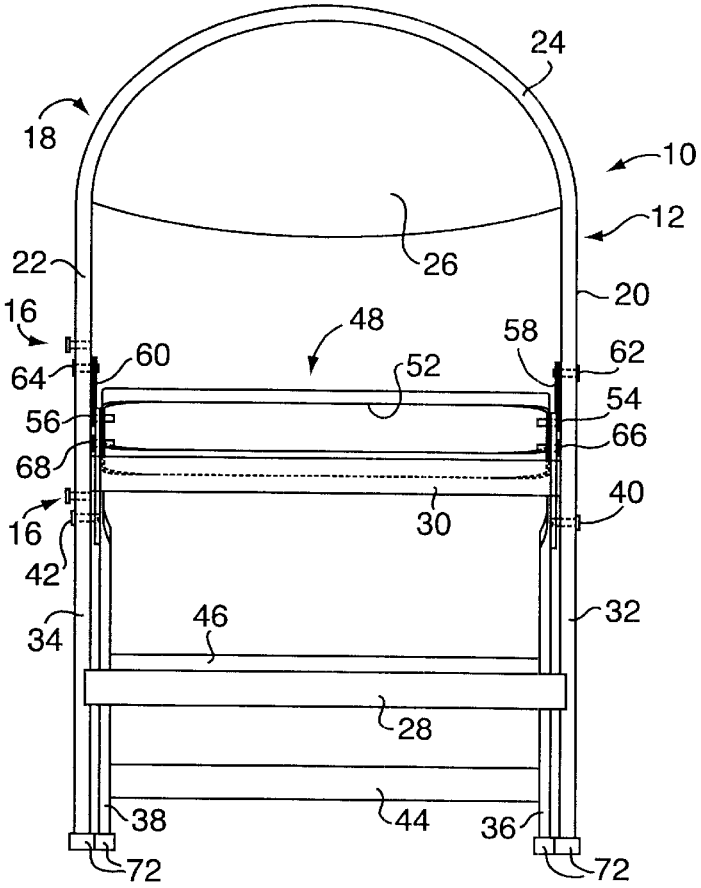
FIG. 1 is a front elevational view of a metal folding chair embodying the present invention shown in setup position.
Figure 2:
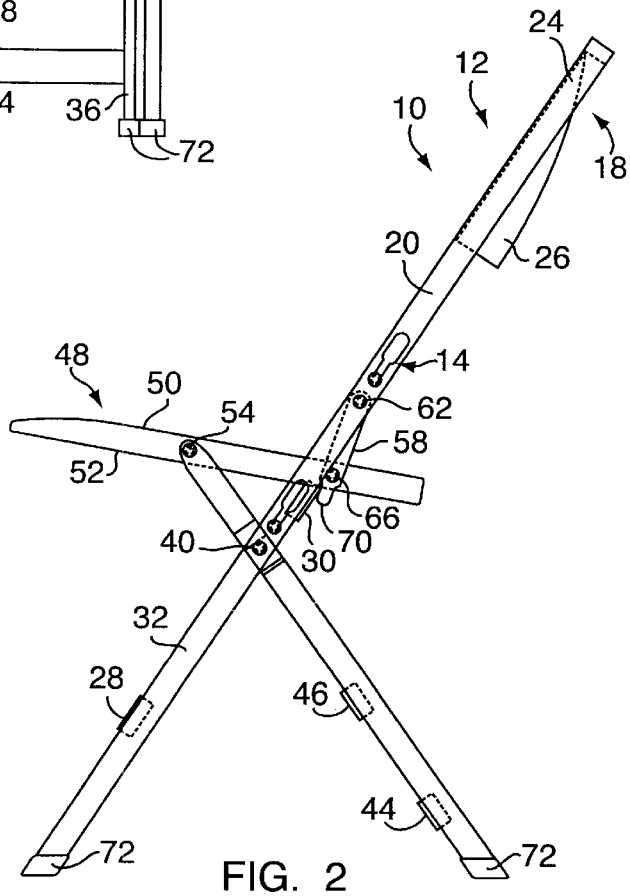
FIG. 2 is a side elevational view of the metal folding chair as it appears in FIG. 1.

The ganging device of the present invention may be utilized with tubular metal folding chairs of various styles and in the drawings and in the description which follows the ganging device forms part of and is illustrated and described with reference to a typical metal folding chair indicated generally by the reference numeral 10. The illustrated chair 10 has a frame designated generally by the reference numeral 12 and formed from tubular metal of generally rectangular cross-section, as hereinafter further discussed. A ganging device in accordance with the present invention and as shown in FIGS. 1 and 2 includes at least one pair or connecting elements. The element of each pair are located at respectively associated opposite sides of the chair frame 12 and include a female connecting element, indicated generally at 14 and shown in FIG. 2, and a male connecting element, designated generally by the numeral 16 and shown in FIG. 1. The illustrated chair 10 carries two pair of connecting elements particularly adapted for releasable coupling the chair in side-by-side relation to one or more other chairs of like kind to form an orderly row or ganged arrangement of connected chairs. However, before further considering the ganging feature and to assure proper understanding of the invention the general construction of the chair 10 will first be described in somewhat more detail.

Further referring to FIGS. 1 and 2, and considering the chair 10 in setup condition, as shown, the tubular frame 12 includes a main frame member, indicated generally at 18, which defines a pair of axially elongated side portions 20 and 22 and a radially arcuate connecting portion 24 integrally connected to and extending transversely between the upper ends of the side portions 20 and 22. The arcuate connecting portion 24 cooperates with the side portions 20 and 22 to support an anatomically contoured backrest 26, which may be welded or otherwise secured to the upper or connecting portion of the main frame member 18, substantially as shown.

A pair of spaced apart horizontally disposed connecting members 28 and 30 are connected to and extend transversely between the side portions 20 and 22 to impart rigidity to the main frame member 18. The lower cross member 28 is disposed adjacent frontal surfaces of the tubular side portions 20 and 22 whereas the upper cross member 30 is disposed adjacent and extends between rear surfaces of the tubular side portions 20 and 22, as best shown in FIG. 2.

In the setup position, shown in FIGS. 1 and 2, the main frame member 18 is upwardly and rearwardly inclined so that the lower part of the main frame member 18 defines a pair of front legs which include a right front leg 32 and a left front leg 34. The upper part or connection portion of the main frame member 18 and the backrest 26 form a chair back.

The chair frame 12 further comprises a pair of axially elongated tubular rear legs of generally rectangular cross section which include a right rear leg 36 and a left rear leg 38. The right and left rear legs 36 and 38 are mounted inwardly adjacent the respectively associated right and left front legs 32 and 34 and are pivotally connected to the front legs by headed pivot pins or rivets 40 and 42. Horizontally disposed cross members 44 and 46 are connected to and extend transversely between the rear legs 36 and 38 and cooperate with the pivotal connections between the rear legs 36 and 38 and the side portions 20 and 22 to impart rigidity to the rear leg assembly.

The illustrated chair 10 has a formed metal seat, indicated generally at 48, which defines an anatomically contoured seating surface 50 surrounded by a depending annular skirt 52. The upper ends of the rear legs 36 and 38 are respectively pivotally connected to the skirt 52 at opposite sides of the seat 48 by headed pivot pins 54 and 56. The rear portion of the chair seat is pivotally connected to the side portions 20 and 22 by respectively associated connecting links 58, 60. The upper ends of the links 58 and 60 are pivotally connected to the side portions 20 and 22 by respectively associated headed pivot pins or rivets 62 and 64. The lower ends of the links 58 and 60 are pivotally connected to the outer sides of the skirt 52 near the rear of the chair seat 48 by headed pivot pins 66 and 68. Each link 58, 60 has a tab 70 depending from its lower end (one tab 70 shown in FIG. 2). When the chair 10 is in setup condition, as shown in FIG. 2, lower edge portions of the skirt 52 at opposite sides of the seat 48 rest upon an upper edge of the cross member 30. The tabs 70, 70 bear against the latter cross member. Thus, the tabs 70, 70 cooperate with the cross member 30 to maintain the chair 10 in its setup position.

Unitary glides 72, 72 are plugged into the lower ends of the tubular legs of the chair and are further retained by pins (not shown) which extend transversely through the legs and through portions of the glides contained within the legs. The glides are preferably made from an elastomeric material which provide non-skid support for the chair and which will not mar, mark or otherwise damage a surface upon which the chair is supported.

As previously noted, the ganging or coupling device which comprises the present invention has at least one pair of connecting elements which include a female connecting element 14 and a male connecting element 16. However, the illustrated chair 10 has two pair of connecting elements associated with the main frame member 18. The two female connecting elements 14, 14 are carried by the right side portion 20 of the main frame member 18, whereas the two male connecting elements 16,16 are mounted on the left side portion 22. It should be understood that the mounting positions of those elements may vary. For this reason a standard must be established for the number and positioning the connecting elements. All chairs which comprise a series of chairs to be connected must be made in accordance with an established standard to assure proper connectability.

Figure 3:
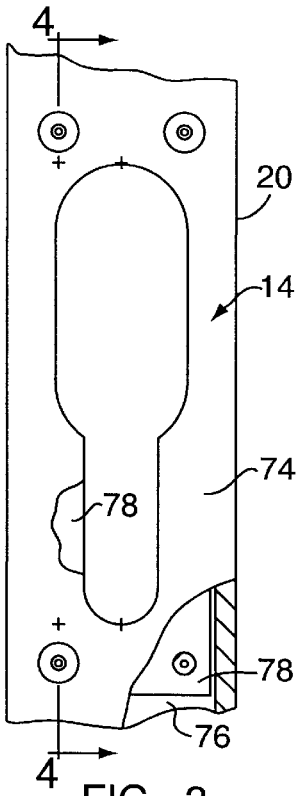
FIG. 3 is a somewhat enlarged fragmentary right side elevational view of the chair of FIG. 1 and shows a female connecting element.
Figure 4:
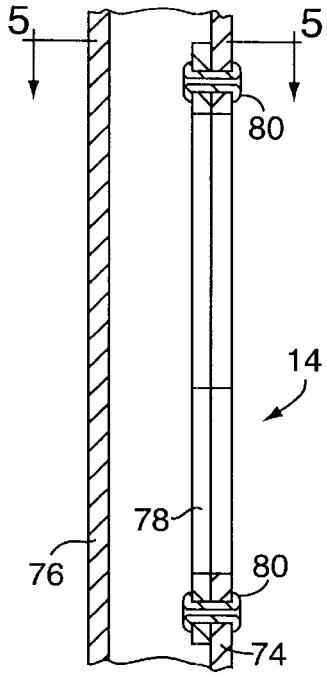
FIG. 4 is a fragmentary sectional view taken along the line 4—4 of FIG. 3.
Figure 5:
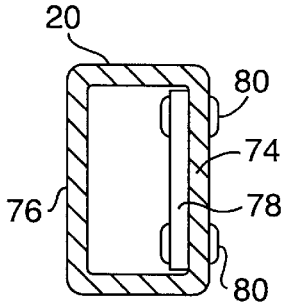
FIG. 5 is a sectional view taken along the line 5—5 of FIG. 4.

Referring now to FIGS. 3–5, a typical female connecting member in accordance with the invention is illustrated in some detail and essentially comprises a keyslot 14 defined by an internally reinforced part of the tubular main frame member right side portion 20. The right side portion 20 has a generally rectangular cross section and includes an outer sidewall 74 and an inner sidewall 76. A reinforcing plate 78 is secured in fixed position within the tubular right side portion 20 adjacent an associated portion of the inner surface of the outer sidewall 74 by a plurality of fasteners or rivets 80, 80. The outer sidewall 74 and the reinforcing plate 78 cooperate to define the keyslot 14 which communicates with the interior of the tubular frame member and opens outwardly through the outer sidewall 74. The female connecting element 14 may be characterized as an elongated slot which extends longitudinally of the right side portion 20 and which has a transversely enlarged portion. In the illustrated embodiment of the invention the transversely enlarged portion comprises the upper end of the keyslot 14.

Each male connecting member 16 is mounted on the main frame member left side portion 22, which also has an outer sidewall 74 and an inner sidewall 76 as previously discussed with reference to the right side portion 20. The essential components which comprise a male connecting element 16 are best shown in the exploded view of FIG. 6 and include an axially elongated stud, indicated generally at 84, and a mating tee nut, designated generally by the numeral 86. The stud 84 has a generally cylindrical body 88 and a diametrically enlarged head 90 at its outer or free end. A diametrically reduced cylindrical shank 92 projects coaxially from the inner end of the body 88 and is threaded along its entire length. A radially disposed and axially inwardly facing annular abutment surface 94 formed on the inner end of the body 88 coaxially surrounds the threaded shank 92, substantially as shown.

Figure 6:
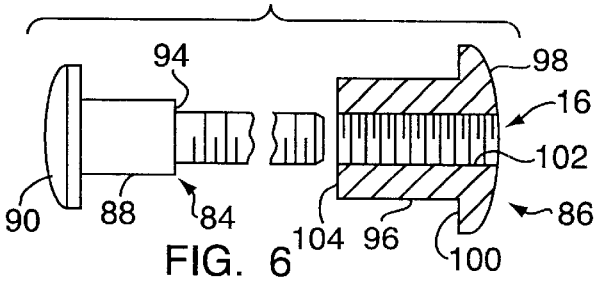
FIG. 6 is an exploded elevational view of a male connecting element.

The tee nut 86 has a generally cylindrical body 96 and a diametrically enlarged head 98 at its inner end. A radially disposed axially outwardly facing first annular bearing surface 100 formed on the head 98 coaxially surrounds the body 96, substantially as shown in FIG. 6. A threaded bore 102 extends coaxially through the cylindrical body 96 for threadable engagement with the shank 92. A second annular bearing surface 104 formed on the tee nut body 96 coaxially surrounds the bore 102 for a purpose which will be hereinafter evident.

Figure 8:
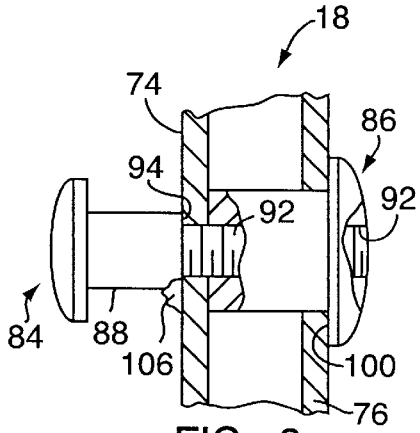
FIG. 8 is a fragmentary sectional view taken along the line 8—8 of FIG. 7.
Figure 7:
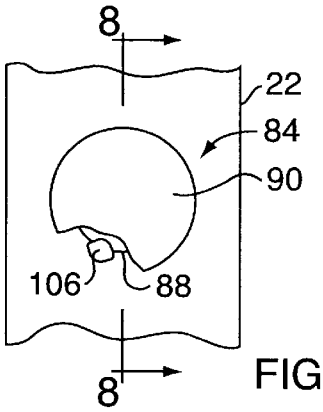
FIG. 7 is a somewhat enlarged fragmentary left side elevational view of the chair of FIG. 1 and shows a male connecting element.
Figure 9:
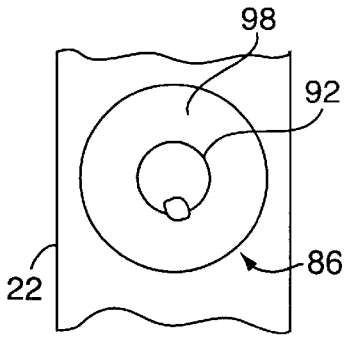
FIG. 9 is a fragmentary right side elevation view of the male connecting element shown in FIGS. 7 and 8.

As previously noted, each male connecting member 16 is mounted on the main frame member left side portion 22 with the stud 84 projecting in cantilever position from the outer sidewall 74. Referring particularly to FIG. 7–9, the tee nut body 96 extends outwardly through a complimentary cylindrical aperture formed in the inner sidewall 76, as best shown in FIG. 8. The tee nut 86 is dimensioned so that the first annular bearing surface 100 bears against an associated portion of the outer surface of the inner sidewall 76, and the second annular bearing surface 104 bears against an associated portion of the inner surface of the outer sidewall 74, substantially as shown in FIG. 8. The threaded shank 92 on the stud 84 passes through a substantially complimentary cylindrical aperture in the outer sidewall 74 and threadably engages the tee nut 86 within the main frame member 18. When the male connecting member 16 is assembled with the chair frame the annular abutment surface 94 is disposed in abutting engagement with an associated portion of the outer surface of the outer sidewall 74, substantially as shown in FIG. 8. The shank 92 is dimensioned to extend entirely through the tee nut 86 and terminate proximate the surface of the head 98, as best shown in FIG. 8.

Further referring to FIG. 8 it will now be apparent that the male connecting element formed by the stud 84 and the tee nut 86 extends entirely through the main frame member 18. The outer sidewall 74 is clampingly disposed between the abutment surface 94 on the stud and the second bearing surface 104 on the tee nut 86. The bearing surface 100 on the head of the tee nut bears against the inner sidewall 76, substantially as shown.

The stud 84 is retained against movement relative to the main frame member 18 by a spot weld 106 shown in FIGS. 7 and 8. Another spot weld 108, shown in FIG. 9 anchors the stud shank 92 to the tee nut head 98, as shown in FIG. 9, thereby preventing separation of the tee nut 86 from the stud 84.

The female keyslot 14 and the male stud 84 are dimensioned to facilitate coupling or interlocking engagement with other connecting elements of like kind, as is well known in the folding chair art, so that the folding chair hereinbefore described maybe coupled to other folding chairs of like kind.

What is claimed is:

1. A metal folding chair comprising; a chair frame including a unitary tubular main frame member having a generally rectangular cross section and including a pair of elongated parallel side portions and a connecting portion integrally connected to said side portions and extending generally transversely therebetween, each of said side portions having an inner sidewall and an outer sidewall and defining a portion of a backrest support, said backrest support being further defined by said connecting portion, a backrest carried by said backrest support, a seat pivotally connected to the frame, and coupling means for releasably securing said folding chair in adjacent side-by-side relation to another chair of like kind and including at least one female connecting member comprising a reinforcing member wholly disposed within said main frame member and secured in fixed position adjacent an associated portion of an inner surface of an associated outer sidewall, said reinforcing member and said associated outer sidewall cooperating to define a keyslot extending through said reinforcing member and said associated outer sidewall, said keyslot communicating with the interior of said tubular main frame member and opening outwardly through said associated outer sidewall.

2. A metal folding chair as set forth in claim 1 wherein said reinforced member includes a reinforcing plate and mounting means for securing said reinforcing plate in fixed position on and within said tubular main frame member in engagement with said inner surface of said associated outer sidewall.

3. A metal folding chair as set forth in claim 2 wherein said mounting means comprises a plurality of fasteners.

4. A metal folding chair as set forth in claim 3 wherein said fasteners comprise rivets.

5. A metal folding chair as set forth in claim 1 wherein said keyslot is further characterized as a slot extending longitudinally of said main frame member and having a transversely enlarged portion.

6. A metal folding chair as set forth in claim 5 wherein said transversely enlarged portion defines an end of said slot.

7. A metal folding chair as set forth in claim 1 wherein said coupling means includes a stud and fastening means for securing said stud in fixed cantilever position and laterally outwardly extending relation to the other of said side portions.

8. A metal folding chair as set forth in claim 7 wherein said stud has an enlarged head at a free end thereof.

9. A metal folding chair as set forth in claim 8 wherein said coupling means comprises a tee nut extending into said main frame member through an opening in said inner sidewall and said stud comprises a threaded fastener threadably engaged with said tee nut within said tubular main frame member.

10. A metal folding chair comprising; a chair frame including a unitary tubular main frame member having a generally rectangular cross section and including a pair of elongated parallel side portions and a connecting portion integrally connected to said side portions and extending generally transversely therebetween, each of said side portions having an inner sidewall and an outer sidewall and defining a portion of a backrest support, said backrest support being further defined by said connecting portion, a backrest carried by said backrest support, a seat pivotally connected to the frame, and coupling means for releasably securing said folding chair in adjacent side-by-side relation to other chairs of like kind and including at least one female connecting member comprising a keyslot defined by an internally reinforced portion of an outer sidewall of an associated one of said side portions and communicating with the interior of said tubular main frame member and opening outwardly through said outer sidewall, said coupling means including a threaded stud and having an enlarged head at a free end thereof and fastening means for securing said stud in fix cantilever position and laterally outwardly extending relation to the other of said side portions including a tee nut extending into said main frame member through an opening in said inner sidewall, said stud threadably engaged with said tee nut within said tubular frame member.

11. A metal folding chair as set forth in claim 10 wherein said stud has a radially disposed axially inwardly facing annular surface engaging an associated portion of the outer surface of said outer sidewall and said tee nut has a radially disposed axially outwardly facing bearing surface engaging an associated portion of the inner surface of said outer sidewall.

12. A metal folding chair as set forth in claim 11 wherein said tee nut has an enlarged head defining an axially outwardly facing annular bearing surface engaging associated portion of the outer surface of said inner sidewall.

13. A metal folding chair as set forth in claim 11 wherein said coupling means includes retaining means for preventing angular movement of said stud about its axis and relative to said main frame member.

14. A metal folding chair as set forth in claim 13 wherein said retaining means comprises a weld anchoring said stud to said tubular main frame member.

15. A metal folding chair as set forth in claim 11 wherein said coupling means includes anchoring means for securing said tee nut against rotation relative to said stud.

16. A metal folding chair as set forth in claim 15 wherein said anchoring means comprises a weld securing said tee nut to said stud.

17. A metal folding chair comprising; a chair frame including a unitary tubular main frame member having a generally rectangular cross section and including a pair of elongated parallel side portions and a connecting portion integrally connected to said side portions and extending generally transversely therebetween, each of said side portions having an inner side wall and an outer side wall and defining a front leg and a portion of a backrest support, said backrest support being further defined by said connecting portion, a backrest carried by said backrest support, a pair of parallel rear legs, each of said rear legs being disposed laterally inwardly adjacent and pivotally connected to an associated one of said front legs, a seat pivotally connected to the frame, and coupling means for releasably securing said folding chair in adjacent side-by-side relation to another chair of like kind and including at least one threaded stud and fastening means for securing said stud in fixed cantilever position and laterally outward extending relation to an associated one of said side portions and including a tee nut extending into said main frame member through an opening in said inner sidewall of said one of said side portions and threadably engaged with said stud within said tubular main frame member, said tee nut having an enlarged head defining a radially disposed axially outwardly facing first annular bearing surface bearing against an associated portion of the inner surface of said inner sidewall and a radially disposed axially outwardly facing second annular bearing surface bearing against an associated portion of the inner surface of said outer sidewall of said one of said side portions, said stud having a generally radially disposed axially inwardly facing abutment surface bearing against an associated portion of the outer surface of said outer sidewall and disposed in axially opposing relation to said second annular bearing surface, said stud having a free outer end defined by an enlarged head.

18. A metal folding chair as set forth in claim 17 wherein said coupling means includes retaining means for preventing angular movement of said stud about its axis and relative to said tubular main frame member.

19. A metal folding chair as set forth in claim 17 wherein said retaining means comprises a first weld anchoring said stud to said tubular frame member.

20. A metal folding chair as set forth in claim 17 wherein said coupling means includes anchoring means for securing tee nut against rotation relative to said stud.

21. A metal folding chair as set forth in claim 20 wherein said anchoring means includes a second weld securing said tee nut to said fastener.

22. A metal folding chair comprising; a chair frame including a unitary tubular main frame member having a generally rectangular cross section and including a pair of elongated parallel side portions and an arcuate connecting portion integrally connected to said side portions and extending generally transversely therebetween, each of said side portions having an inner sidewall and an outer sidewall and defining a front leg and a portion of a backrest support, said backrest support being further defined by said connecting portion, a backrest carried by said backrest support, a pair of parallel rear legs, each one of said rear legs being disposed laterally inwardly adjacent and pivotally connected to an associated one of said front legs, a seat pivotally connected to the frame, and coupling means for releasably securing said folding chair in adjacent side-by-side relation to another chair of like kind and including at least one female connecting member comprising a keyslot defined by an internally reinforced portion of an outer sidewall of an associated one of said side portions and communicating with the interior of said tubular mainframe member and opening outwardly through said outer sidewall, said coupling means further including at least one threaded stud and fastening means for securing said stud in fixed cantilever position and laterally outward extending relation to an associated one of said side portions and including a tee nut extending into said main frame member through an opening in said inner sidewall of said one of said portions and threadably engaged with said stud within said tubular main frame member, said tee nut having an enlarged head defining a radially disposed axially outwardly facing first annular bearing surface bearing against an associated portion of the outer surface of said inner sidewall and a radially disposed axially outwardly facing second annular bearing surface bearing against an associated portion of the inner surface of said outer sidewall of said one of said side portions, said stud having a generally radially disposed axially inwardly facing abutment surface bearing against an associated portion of the outer surface of said outer sidewall and disposed in axially opposing relation to said second annular bearing surface, said stud having a free outer end defined by an enlarged head.

* * * * *

UNITED STATES PATENT AND TRADEMARK OFFICE

CERTIFICATE OF CORRECTION

PATENT NO. : 6,478,375 B2
DATED : November 12, 2002
INVENTOR(S) : Richardson

It is certified that error appears in the above-identified patent and that said Letters Patent is hereby corrected as shown below:

Title page,
Item [*] Notice:, "Subject to any disclaimer, the term of this patent is extended or adjusted under 35 USC 154(b) by (0) days", delete the phrase "by 0 days" and insert -- by 23 days --

Signed and Sealed this

Twenty-first Day of October, 2003

JAMES E. ROGAN
*Director of the United States Patent and Trademark Office*